US012188347B2

(12) United States Patent
Beale

(10) Patent No.: US 12,188,347 B2
(45) Date of Patent: Jan. 7, 2025

(54) TUBING ASSEMBLY FOR USE IN WELLBORE AND METHOD OF RUNNING TUBING IN A WELLBORE

(71) Applicant: Expro North Sea Limited, Dyce (GB)

(72) Inventor: Stephen James Beale, Dyce (GB)

(73) Assignee: Expro North Sea Limited, Dyce (GB)

( * ) Notice: Subject to any disclaimer, the term of this patent is extended or adjusted under 35 U.S.C. 154(b) by 41 days.

(21) Appl. No.: 17/802,853

(22) PCT Filed: Feb. 9, 2021

(86) PCT No.: PCT/EP2021/053107
§ 371 (c)(1),
(2) Date: Aug. 26, 2022

(87) PCT Pub. No.: WO2021/170399
PCT Pub. Date: Sep. 2, 2021

(65) Prior Publication Data

US 2023/0108445 A1 Apr. 6, 2023

(30) Foreign Application Priority Data

Feb. 26, 2020 (GB) ..... 2002693

(51) Int. Cl.
*E21B 47/07* (2012.01)
*E21B 47/12* (2012.01)

(52) U.S. Cl.
CPC ..... *E21B 47/07* (2020.05); *E21B 47/12* (2013.01)

(58) Field of Classification Search
CPC ..... E21B 47/07; E21B 47/12
See application file for complete search history.

(56) References Cited

U.S. PATENT DOCUMENTS 4,105,279 A * 8/1978 Glotin ..... E21B 47/017 439/700
2010/0139388 A1* 6/2010 Griffiths ..... E21B 47/008 73/152.51
2017/0336525 A1* 11/2017 Wilson ..... G01V 3/28
2019/0128113 A1* 5/2019 Ross ..... E21B 47/12

FOREIGN PATENT DOCUMENTS

WO WO-2008112331 A1 * 9/2008 ..... E21B 17/023

* cited by examiner

*Primary Examiner* — Crystal J Lee
(74) *Attorney, Agent, or Firm* — Getz Balich LLC

(57) ABSTRACT

A tubing assembly for use in a wellbore is provided. The tubing assembly includes tubing configured to be run in a wellbore to recover downhole fluid from a formation; and at least one gauge positioned at least partially inside the tubing. The gauge is configured to detect a parameter inside the tubing.

14 Claims, 12 Drawing Sheets

TUBING ASSEMBLY FOR USE IN WELLBORE AND METHOD OF RUNNING TUBING IN A WELLBORE

This application claims priority to PCT Patent Appln. No. PCT/EP2021/053107 filed Feb. 9, 2021, which claims priority to GB Patent Appln. No. 2002693.6 filed Feb. 26, 2020, which are hereby incorporated herein by reference in their entireties.

BACKGROUND OF THE INVENTION

1. Technical Field

The subject application generally relates to tubing, and specifically to a tubing assembly for use in a wellbore and a method of running tubing in a wellbore.

2. Background Information

The oil and gas industry utilizes a variety of gauges or sensors to detect pressure, temperature, pH, force, stress, strain and resistivity or electrical properties. When a gauge is deployed downhole, it is typically affixed to the outside of tubing or piping that is surrounded by well casing, unless the well is an open hole well. Specifically, the gauge is typically clamped to the outer wall of the tubing.

Downhole gauges that are clamped to the outer wall of tubing are exposed during deployment and recovery. As such, the clamped gauges are vulnerable to damage during run in and out of the wellbore.

Furthermore, the clamped gauges are present in the annulus between the tubing and casing. Due to the gauge being present in the annulus, the diameter of the tubing is restricted to a sub-optimal level. This may reduce fluid flow and, result in a decrease in downhole fluid recovery and efficiency.

In addition, the gauges are clamped to one side of the tubing causing the combination of the tubing and gauge to be eccentric to the wellbore. This increases the side force as the gauge clamped to the tubing rotates the tubing with the clamp to one side. This may increase the frictional force or frictional loading during deployment of the tubing, in particular in areas where the gauge is proximate concentric devices such as a packer. In addition, any tubing rotation increases the risk of the tubing and gauge becoming stuck in the casing. Moreover, flexible tubing joints are required between the sections of tubing having a clamped gauge, and other sections of tubing that require concentric connections, such as packers and plugs.

This background serves only to set a scene to allow a person skilled in the art to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY

In some or more examples, a tubing assembly for use in a wellbore is provided. The provided tubing assembly is more robust and/or efficient than prior tubing and gauge assemblies. In exemplary methods and apparatus, one or more problems associated with the art, such as those discussed above, may be solved.

In some or more examples, the tubing assembly comprises tubing configured to run in a wellbore to recover downhole fluid from a formation; and at least one gauge positioned at least partially inside the tubing, the gauge configured to detect a parameter inside the tubing. In some exemplary arrangements, at least one gauge may be positioned entirely inside the tubing.

In some or more examples, the gauge is mounted inside the tubing.

In some or more examples, the tubing is configured for use in downhole fluid recovery or during other phases of a well life cycle. For example, the tubing is configured for use during abandonment, completion and/or production.

In some or more examples, the tubing is generally cylindrical.

In some or more examples, the wellbore forms part of a well. In some or more examples, the well is an on-shore or an offshore well. In some or more examples, the well is an abandoned well, an appraisal well or a production well. In some or more examples, the well is a methane hydrate well.

The described tubing assembly provides an arrangement in which the at least one gauge is not exposed during deployment of the tubing assembly and recovery of the tubing assembly. As stated, the gauge is positioned at least partially inside the tubing and as such, is less vulnerable to damage than prior art arrangements. In particular, as the gauge is at least partially inside or internal to the tubing, the portion of the gauge that is inside or internal to the tubing is not exposed during deployment and is less likely to be damaged by contact with, for example, the wellbore, outer casing, etc. during deployment or recovery.

As the gauge is positioned at least partially inside the tubing, the portion of the gauge that is inside or internal to the tubing is not present in the annulus defined between the tubing, and outer casing or lining, if the well is not an open hole well. As such, the diameter of the tubing may be increased beyond the sub-optimally reduced diameter present in prior arrangements due to the presence of the gauge in the annulus. The diameter may be increased to an optimal diameter.

In addition, as the gauge is positioned at least partially inside the tubing, the tubing need not be eccentric, relative to casing, due to the presence of the gauge clamped to the outside of the tubing. This may reduce side force on the tubing. Furthermore, this may reduce frictional force or frictional loading during deployment of the tubing arrangement. In addition, the risk of the tubing arrangement becoming stuck in casing is reduced. Moreover, flexible tubing joints may not necessarily be required between the sections of tubing arrangement, and other sections of tubing that require concentric connections, such as packers and plugs.

In some or more examples, the gauge is ported through the tubing such that the gauge is configured to detect a parameter inside the tubing and a parameter outside the tubing.

In some or more examples, the gauge is configured to detect the same parameter inside and outside of the tubing. In some or more examples, the gauge is configured to calculate a differential between the detected parameters.

In some or more examples, the gauge is ported through a sidewall of the tubing.

In some or more examples, at least a portion of the gauge is positioned at least partially outside the tubing.

In some or more examples, the gauge comprises a first sensing element positioned inside the tubing.

In some or more examples, the first sensing element is positioned in a bore of the tubing, the first sensing element configured to detect the parameter inside the bore.

In some or more examples, the gauge comprises a second sensing element. In some or more examples, the second sensing element is positioned in a bore of the tubing.

In some or more examples, the second sensing element is configured to detect a parameter outside of the tubing. In some or more examples, the second sensing element is configured to detect a parameter in an annulus between the tubing and casing surrounding the tubing.

In some or more examples, the first and second sensing elements are configured to detect the same or different parameters.

In some or more examples, the gauge is configured to compare the parameters detected by the first and second sensing element. In some or more examples, the gauge is configured to determine the difference between the parameters detected by the first and second sensing element.

In some or more examples, the gauge is configured to determine the difference in the parameter, e.g. pressure, within the annulus of the tubing and outside of the bore of the tubing. The gauge can therefore determine the parameter delta. The difference or delta is useful in optimizing flow rates in the bore of the tubing and/or in the annulus defined between outer casing and the tubing.

In some or more examples, at least a portion of the gauge is attached to the tubing. In some or more examples, the gauge is secured to the tubing. In some or more examples, the gauge is affixed to the tubing.

In some or more examples, at least a portion of the gauge is at least one of bolted to the tubing and clamped to the tubing. In some or more examples, at least a portion of the gauge is secured to the tubing by expanding friction clamp.

In some or more examples, the sensing elements are interconnected.

In some or more examples, the sensing elements form a sensor that is ported through the tubing. The sensor is ported through a sidewall of the tubing such that the first sensing element is configured to detect a parameter in the tubing (i.e. in the bore) and the second sensing element is configured to detect a parameter outside of the tubing, e.g. in the annulus of the casing. In some or other examples, the sensor is secured to the tubing by expanding friction clamp.

In some or more examples, the gauge comprises a gauge body. The gauge body may be positioned against an internal wall of the tubing. The gauge body may be jelly-bean shaped. The gauge body may be positioned such that the gauge body is coincident with the longitudinal central axis of the tubing. The center of mass of the gauge body may be coincident with the longitudinal central axis of the tubing.

In some or more examples, at least a portion of the gauge is secured to the tubing by a fastener. The portion of the gauge may be the gauge body. The fastener may be a bolt. The bolt head or some portion of the bolt may be external to the tubing. The bolt head may be flush with the tubing such that no portion of the bolt and/or gauge is external to the tubing. The tubing may thus be cylindrical.

In some or more examples, the bolt is blanked. In some or more examples, the bolt comprises a passageway from the annulus between the tubing and surrounding casing, and the bore of the tubing. The passageway provides fluid communication between the annulus and the bore.

In some or more examples, the passageway is at least partially threaded. A plug may be secured to an end of the passageway within the bore. The plug may be threaded into the end of the passageway. The plug is configured to prevent fluid from flowing from within the annulus to the bore of the tubing.

In some or more examples, the bolt is secured to the tubing by a fastener. The fastener may be one or more screws securing the bolt head to the tubing. The fastener may be axially parallel with a longitudinal axis of the bolt.

In some or more examples, the bolt is secured to the gauge body by a fastener. The fastener may be one or more screws securing the bolt to the gauge body. The fastener may be axially perpendicular with a longitudinal axis of the bolt.

In some or more examples, one or more ports is positioned within at least a portion of the gauge. In some or more examples, one or more ports is positioned within the passageway and or gauge body. In some or more examples, at least one sensing element is configured to detect a parameter via at least one port. The ports may comprise a bore port within the gauge body, and an annulus port within the passageway. The first sensing element may be configured to detect a parameter in the bore of the tubing via the bore port. The second sensing element may be configured to detect a parameter in the annulus defined between the tubing and surrounding casing via the annulus port. In some or more examples, one or more ports are positioned within a portion of the gauge, and wherein the first and/or second sensing element is configured to detect a parameter via at least one port.

In some or more examples, at least one port is positioned within a gauge body of the gauge.

In some or more examples, at least one port is positioned within a passageway within a fastener configured to secure a gauge body of the gauge to the tubing.

In some or more examples, the passageway provides fluid communication between a bore of the tubing and outside the tubing.

In some or more examples, the gauge comprises multiple sensors. Each sensor may be configured to detect the same or different parameters.

In some or more examples, the first and/or second sensing element is communicatively connected to a module. In some or more examples, the module is a communication module.

In some or more examples, the gauge further comprises a module or communication module communicatively connected to the sensing elements. The module or communication module is located in the tubing, specifically in the bore of the tubing. The module or communication module is configured to receive parameters detected by the sensing elements.

In some or more examples, the module or communication module is configured to store or record parameters detected by one or more sensing elements.

In some or more examples, the module or communication module comprises a processor.

In some or more examples, the processor is configured to calculate a difference between a parameter detected in the tubing (i.e. from the first sensing element) and a parameter detected outside of the tubing (i.e. from the second sensing element).

In some or more examples, the tubing assembly further comprises a communication module configured to communicate a signal. In some or more examples, the communication module is configured to compare the parameters detected by the first and second sensing element. In some or more examples, the communication module is configured to determine the difference between the parameters detected by the first and second sensing element.

In some or more examples, the communication module is configured to determine the difference in the parameter, e.g. pressure, within the annulus of the tubing and outside of the bore of the tubing. The communication module can therefore determine the parameter delta. The difference or delta is useful in optimizing flow rates in the bore of the tubing and/or in the annulus defined between outer casing and the tubing.

In some or more examples, the tubing assembly further comprises a communication module configured to receive a signal and/or transmit a signal.

In some or more examples, the tubing assembly further comprises a communication module configured to communicate a signal with communication modules, other gauges, tubing assemblies, and/or a remotely located controller or storage. In some or more examples, the communication module is configured to transmit and/or receive a signal to/from another gauge, tubing assembly, and/or a remotely located controller or storage.

Having a communication module form part of the tubing assembly allows for communication between gauges, e.g. communication modules, of different tubing assemblies. In particular, a first tubing assembly closest to the surface or to the topmost side of the wellbore may receive one or more signals. The communication module of the first tubing assembly may then communicate a received signal to another communication module. The communication module may be part of a second tubing assembly. The second communication module may then communicate the signal to a third communication module forming part of the third tubing assembly. This relaying of the signal allows for the tubing assembly farthest away from the surface or bottommost tubing assembly to receive information despite its location being the most remote.

In some or more examples, the communication module is configured to communicate, transmit and/or receive via wired and/or wireless communication. Wired communication methods are through a guided transmission medium, such as a wire or a material having high electromagnetic (EM) conductivity relative to a surrounding medium. Wired communication methods may utilize e-lines, slicklines, fiber optic cabling, etc. Wireless communication methods are not through a guided transmission medium. Wireless communication methods are through air, water, ground (or formation) or another medium such as tubing or casing. In some or more examples, wireless communication methods utilize electromagnetic technology, acoustic technology and/or pressure wave technology, or combinations thereof.

In some or more examples, the communication module is configured to communicate, transfer and/or receive via a combination of wired and wireless communication. For example, a signal may be communicated using an EM and/or acoustic signal travelling through casing for some portion of the signal path, then optionally via an electric cable and then through tubing using an EM signal.

In some or more examples, the signal is at least one of a power signal and a data signal.

In some or more examples, the power signal provides electrical power to components of the tubing assembly. In some or more examples, the power signal power electrical power to a gauge of a tubing assembly.

In some or more examples, the data signal is a control signal. In some or more examples, the control signal is configured to control a gauge. In particular, the control signal is configured to activate the gauge, control detection of one or more parameter by the gauge and control transmission of one or more detected parameters by the gauge and/or an associated communication module.

In some or more examples, the module is another gauge or a remotely located module. In some or more examples, the remotely located module is another communication module. In some or more examples, the other communication module is located at the surface. In some or more examples, the other communication module forms part of another tubing assembly. In some or more examples, the other gauge forms part of another tubing assembly.

In some or more examples, the wellbore is lined with casing. The casing, outer casing or lining is run into the wellbore prior to the tubing being run into the wellbore. The casing is configured to isolate the formation, stabilize the wellbore and/or protect equipment encapsulated by the casing. In some or more examples, the casing is cemented into place within the wellbore. In some or more examples, the casing is configured to protect the formation form casing into the wellbore. In some or more examples, the casing is generally cylindrical.

In some or more examples, the tubing assembly is configured to be positioned within the casing. In some or more examples, the casing is generally cylindrical. The tubing is generally cylindrical.

In some or more examples, the tubing assembly is configured to be positioned radially centrally within the casing. A packer may be used to position the tubing within the casing.

In some or more examples, the tubing is production tubing. In some or more examples, the tubing is configured for use in extracting production fluid from a formation.

In some or more examples, the parameter is at least one of pressure, temperature, pH, force, strain, stress, tension, resistivity and conductivity.

In some or more examples, the tubing assembly is configured for use with a screen configured to separate particles from fluid. In some or more examples, the screen is a sand screen. In some or more examples, the sand screen is configured to separate sand particles from fluid entering the bore of the tubing.

In some or more examples, the screen is configured to be wrapped around the tubing. In some or more examples, the screen is generally cylindrical. In some or more examples, the screen generally surrounds the tubing.

In some or more examples, the gauge is configured to detect a parameter within the screen and outside of the screen. The gauge is configured to detect a parameter in the bore of the tubing. The gauge is further configured to detect a parameter in the annulus defined between casing and the tubing. The gauge is configured to be ported through the tubing. Because the gauge is ported through the tubing, the gauge can detect parameters on either side of the screen, i.e. in the bore and in the annulus. In comparison with prior art arrangements, large portions of the screen need not be sacrificed which reduces the ability of the screen to separate particles from fluid. This may decrease efficiency and result in sub-optimal fluid flow.

In some or more examples, the tubing assembly is configured for use in a methane hydrate well.

In some or more examples, a method of running tubing in a wellbore is provided.

In some or more examples, the method comprises positioning at least one gauge partially inside tubing to form a tubing assembly, the tubing configured for use in recovering downhole fluid from a formation and the gauge configured to detect a parameter inside the tubing; and installing the tubing assembly in the wellbore.

In some or more examples, the tubing is configured for use in downhole fluid recovery or during other phases of a well life cycle. For example, the tubing is configured for use during abandonment, completion and/or production.

In some or more examples, the wellbore forms part of a well. In some or more examples, the well is an on-shore or an offshore well. In some or more examples, the well is an abandoned well, an appraisal well or a production well.

The described method provides a method in which the gauge is positioned partially inside tubing such that the gauge is less vulnerable to damage than prior art arrangements. In particular, as the gauge is at least partially inside or internal to the tubing, the portion of the gauge that is inside or internal to the tubing is not exposed during deployment and cannot be damaged by contact with, for example, the wellbore, outer casing, etc. during deployment or recovery.

As the gauge is positioned at least partially inside the tubing, the portion of the gauge that is inside or internal to the tubing is not present in the annulus defined between the tubing and outer casing, if the well is not an open hole well. As such, this portion of the gauge does not restrict fluid flow within the annulus. In addition, the diameter of the tubing may be increased beyond the sub-optimally reduced diameter present in prior arrangements due to the presence of the gauge in the annulus. The diameter may be increased to an optimal amount.

In addition, as the gauge is positioned at least partially inside the tubing, the tubing need not be eccentric, relative to casing, due to the presence of the gauge clamped to the outside of the tubing. This may reduce side force on the tubing. Furthermore, this may reduce frictional force or frictional loading during deployment of the tubing arrangement. In addition, the risk of the tubing arrangement becoming stuck in the casing is reduced. Moreover, flexible tubing joints may not necessarily be required between the sections of tubing arrangement, and other sections of tubing that require concentric connections, such as packers and plugs.

In some or more examples, positioning the gauge comprises porting the gauge through the tubing such that the gauge is configured to detect a parameter inside the tubing and a parameter outside the tubing. In some or more examples, porting comprises porting the gauge through a sidewall of the tubing.

In some or more examples, the parameters detected inside the tubing and outside the tubing are the same or different.

In some or more examples, porting the gauge comprises positioning a first sensing element of the gauge inside a bore of the tubing.

In some or more examples, porting the gauge comprises positioning a second sensing element of the gauge outside the tubing.

In some or more examples, the method further comprises detecting the parameter inside and/or outside the tubing.

In some or more examples, the method further comprises comparing the detected parameter inside the tubing with the detected parameter outside the tubing. In some or more examples, comparing comprises determining a difference or delta between the first detected parameters.

In some or more examples, positioning comprises positioning at least one sensing element within the tubing to detect a parameter via at least one port positioned within a portion of the gauge. In some or more examples, the port is positioned within a gauge body of the gauge. The port may be a bore port. The first sensing element may be positioned to detect a parameter in the bore via the bore port.

In some or more examples, the port is positioned within a fastener configured to secure the gauge to the tubing. This port may be an annulus port. The second sensing element may be positioned to detect a parameter in the annulus via the annulus port.

In some or more examples, the gauge comprises a gauge body positioned within the tubing. The gauge body may be secured to the tubing with a bolt. The bolt may comprise a passageway defining a fluid communication path between the annulus and the bore. The annulus port may be positioned within the passageway.

In some or more examples, the passageway is plugged to prevent fluid communication into the bore of the tubing. The passageway may be plugged by a plug. The plug may be threaded into the passageway of the bolt.

In some or more examples, positioning the gauge comprises attaching the gauge to the tubing.

In some or more examples, attaching the gauge comprises at least one of bolting the gauge to the tubing and clamping the gauge to the tubing.

In some or more examples, attaching the gauge comprises bolting a gauge body of the gauge to the tubing with a bolt. The bolt may have a passageway with an annulus port via which the seconding sensing element is configured to detect a parameter in the annulus. The passageway may be threaded.

In some or more examples, the method further comprises securing the bolt to the tubing and/or gauge body of the gauge. Securing may comprise securing the bolt to the tubing via a fastener such as one or more screws. The screws may secure the bolt head to the tubing. Securing may comprise securing the bolt to the gauge via fastener such as one or more screws. The screws may secure the bolt shank and/or threaded portion to the gauge body. By securing the bolt to the gauge body, the bolt is less likely to fall and therefore the gauge body is less likely to be unsecured from the tubing. Furthermore, by securing the bolt to the gauge body via screws in the shank of the bolt, the threaded portion of the bolt is unaffected which does not affect the fastening ability of the bolt.

In some or more examples, the method further comprises plugging the passageway of the bolt securing the gauge body of the gauge to the tubing. Plugging may comprise screwing a plug into the passageway.

In some or more examples, attaching the gauge comprises forming a hole in the tubing and positioning at least a portion of the gauge in the hole such that the gauge is configured to detect a parameter in the bore of the tubing and/or in the annulus of the casing. In some or more examples, the portion of the gauge comprises a sensor. In some or more examples, the sensor comprises a first sensing element and a second sensing element. In some or more examples, the first sensing element is interconnected or connected to the second sensing element. In some or more examples, the first sensing element is configured to detect a parameter in the bore. In some or more examples, the second sensing element is configured to detect a parameter in the annulus.

The gauge may be flush with the tubing outer surface such that the diameter is not increased by the gauge. In this manner, the gauge does not increase the overall diameter of the tubing and the tubing may be of optimal diameter.

In some or more examples, porting the gauge comprises attaching the sensor to the tubing. In some or more examples, porting the gauge comprises forming a hole in the sidewall of the tubing and positioning the sensor in the hole of the tubing such that the first sensing element is configured to detect a parameter in the bore and the second sensing element is configured to detect a parameter in the annulus.

In some or more examples, the sensor is attached to the tubing by one of friction fit, expanding friction clamp, bolting and clamping to the tubing.

In some or more examples, the method further comprises communicating a signal. In some or more examples, communicating the signal comprises communicating the signal from the gauge.

In some or more examples, communicating comprises communicating the signal via wired and/or wireless communication. Wired communication methods are through a guided transmission medium, such as a wire, other metallic structure or a material having high electromagnetic (EM) conductivity relative to a surrounding medium. Wired communication methods may utilize e-lines, slicklines, fiber optic cabling, etc. Wireless communication methods are not through a guided transmission medium. Wireless communication methods are through air, water, ground (or formation) or another medium such as tubing or casing. In some or more examples, wireless communication methods utilize electromagnetic technology, acoustic technology and/or pressure wave technology, or combinations thereof.

In some or more examples, the communication module is configured to communicate, transmit and/or receive via a combination of wired and wireless communication. For example, a signal may be communicated using an EM and/or acoustic signal travelling through casing for some portion of the signal path, then optionally via an electric cable and then through tubing using an EM signal.

In some or more examples, the signal is at least one of a power signal and a data signal.

In some or more examples, the power signal provides electrical power to components of the tubing assembly. In some or more examples, the power signal provides electrical power to a gauge of a tubing assembly.

In some or more examples, the data signal is a control signal. In some or more examples, the control signal is configured to control a gauge. In particular, the control signal is configured to activate the gauge, control detection of one or more parameters by the gauge and control transmission of one or more detected parameters by the gauge and/or an associated communication module.

In some or more examples, the communicating comprises communicating the signal from the gauge to another gauge, and/or a remotely located controller or storage. In some or more examples, the other gauge forms part of another tubing assembly.

In some or more examples, the method further comprises, prior to installing the tubing assembly, lining the well hole with casing. The casing or outer casing is run into the wellbore prior to the tubing being run into the wellbore. The casing is configured to isolate the formation, stabilize the wellbore and/or protect equipment encapsulated by the casing. In some or more examples, the casing is cemented into place within the wellbore. In some or more examples, the casing is configured to protect the formation form casing into the wellbore. In some or more examples, the casing is generally cylindrical.

In some or more examples, the tubing is configured to be positioned within the casing.

In some or more examples, the tubing is production tubing.

In some or more examples, the parameter is at least one of pressure, temperature, pH, force, strain, stress, tension, resistivity and conductivity.

Aspects of the inventions described may include one or more examples, embodiments or features in isolation or in various combinations whether or not specifically stated (including claimed) in that combination or in isolation.

BRIEF DESCRIPTION OF THE DRAWINGS

A description is now given, by way of example only, with reference to the accompanying drawings, in which.

DETAILED DESCRIPTION OF THE INVENTION

Figure 1:
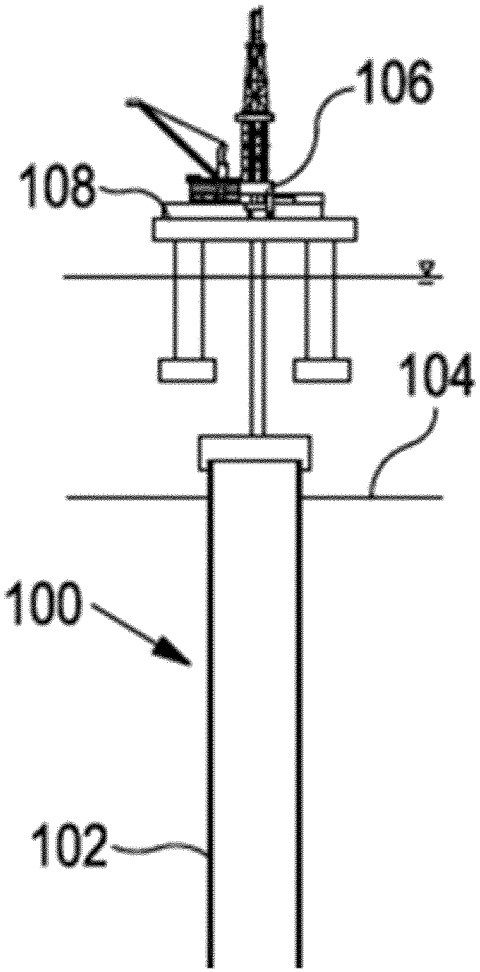
FIG. 1 is a simplified representation of a well structure with a downhole tool.

The foregoing summary, as well as the following detailed description of certain embodiments will be better understood when read in conjunction with the accompanying drawings. As will be appreciated, like reference characters are used to refer to like elements throughout the description and drawings. As used herein, an element or feature recited in the singular and preceded by the word "a" or "an" should be understood as not necessarily excluding a plural of the elements or features. Further, references to "one example" or "one embodiment" are not intended to be interpreted as excluding the existence of additional examples or embodiments that also incorporate the recited elements or features of that one example or one embodiment. Moreover, unless explicitly stated to the contrary, examples or embodiments "comprising", "having" or "including" an element or feature or a plurality of elements or features having a particular property might further include additional elements or features not having that particular property. In addition, it will be appreciated that the terms "comprises", "has" and "includes" mean "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of describing the relationship of an element or feature to another element or feature as depicted in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, or within less than 0.01% of the stated amount.

Some of the following examples have been described specifically in relation to well infrastructure relating to oil and gas production, or the like, but of course, the systems and methods may be used with other well structures. Similarly, while in the following example an offshore well structure is described, nevertheless the same systems and methods may be used onshore, as will be appreciated.

Turning now to FIG. 1, a simplified representation of a section of a well 100 is shown. In FIG. 1, the well 100 is an offshore well, although this is only exemplary. A well structure 102 extends from the surface to a subterranean formation. In this embodiment, the surface is the seabed or mudline 104. The well structure 102 may comprise a conductor, casing and other tubing used to recover product from the subterranean formation. The well 100 comprises a wellhead 106, wet tree or the like, at a production platform 108. In other embodiments, the wellhead 106 may be located at the mudline 104.

As a person skilled in the art will appreciate, the well 100 may further comprise an open hole section, in that there is no well structure positioned within the well 100 in the open hole section. The open hole structure may be lower than the well structure. The open hole structure may be located above the well structure 102. Similarly, a person skilled in the art will appreciate that the well 100 may be any one of a production well, injection well, appraisal well or a side track of an existing well.

Figure 2:
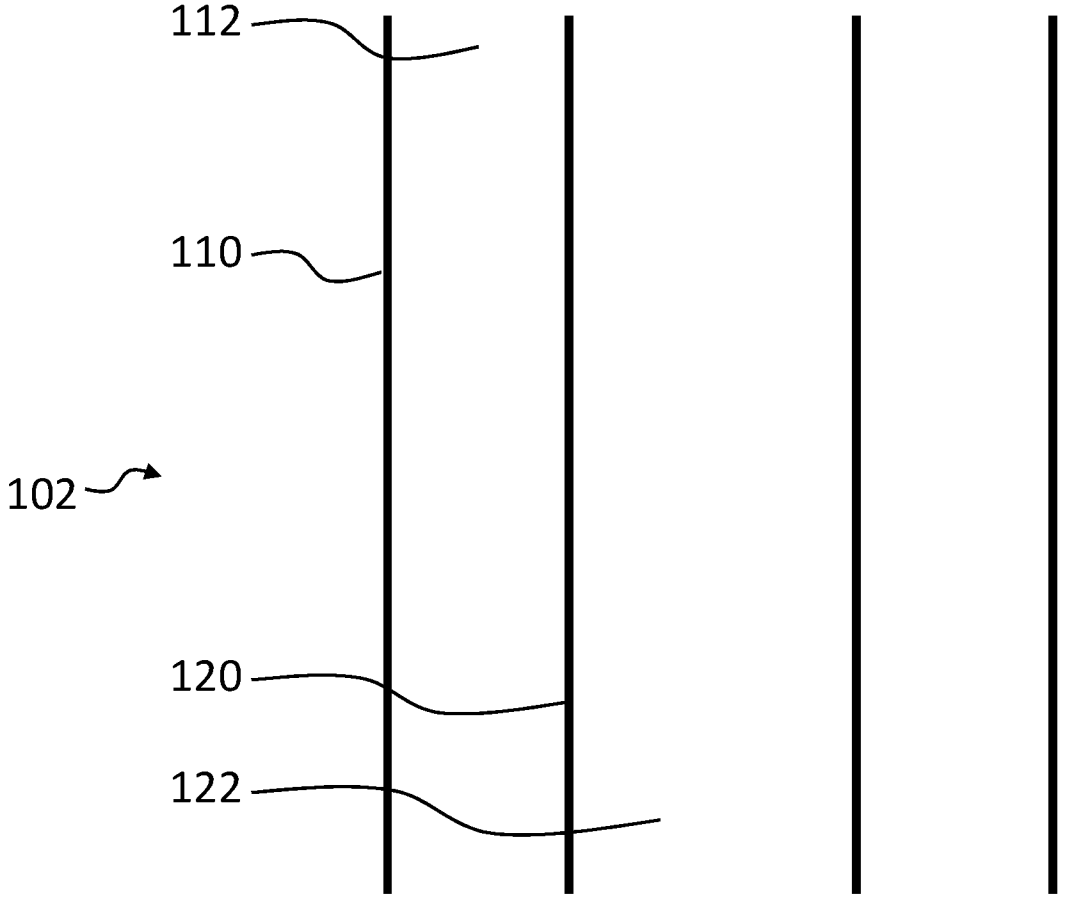
FIG. 2 is a longitudinal cross-sectional view of a portion of a well structure.

Turning now to FIG. 2, a longitudinal cross-sectional view of a portion of the well structure 102 is shown. The well structure 102 is generally cylindrical. In this embodiment, the well structure 102 comprises lining, outer casing or casing 110 forming the exterior of the well structure 102 and piping or tubing 120 in the interior of the well structure 102.

The casing 110 serves to prevent the formation exterior to the casing 110 from caving into the wellbore of the well 100. The casing 110 may further or alternatively, isolate different formations to prevent the flow or cross flow of formation fluid. The casing 110 may further or alternatively, provide a means of maintaining control of formation fluids and pressure as the well 110 is drilled.

The casing 110 is generally cylindrical. In this embodiment, the casing 110 comprises steel pipe, although other materials may be used. The casing 110 is hollow. The casing 110 comprises interconnected casing segments, which form an entire casing run. The casing 110 runs for some portion or the entire longitudinal length of the wellbore of the well 100. In use, the casing is generally cemented into place within the well 100 once the wellbore is drilled.

The casing 110 defines an interior generally cylindrical volume known. The tubing 120 is positioned within this volume to form an annulus 112. The tubing 120 is within the interior defined by the casing 110. In exemplary arrangements, the tubing 120 is radially centrally located within the annulus 112. The tubing 120 may be radially centrally positioned using one or more packers (not shown). The packers may be mechanical set packets, tension-set packers, rotation-set packers, hydraulic-set packers, inflatable packers, permanent packers and/or cement packers.

The tubing 120 is configured to be run in a wellbore, e.g. the wellbore of well 100, to recover downhole fluid from one or more formations. In this embodiment, the tubing 120 is production tubing. The tubing 120 forms part of the production string through which production fluid from the formation runs. The tubing 120 runs for some portion or the entire longitudinal length of the wellbore of the well 100. The tubing 120 is generally cylindrical. The tubing 120 is hollow. The tubing 120 defines an interior generally cylindrical volume known as a bore 122. The tubing 120 may be made of steel, steel alloys or other generally corrosive resistant materials in which production fluid may flow.

In this embodiment, the casing 110 surrounds the tubing 120, however, as will be appreciated, in open hole portions of the well 100, no casing 110 may be present, and the tubing 120 may not be surrounded by casing 110. In operation, the tubing 120 is run into the wellbore of the well 100 to recover downhole fluid (production fluid) from one or more formations.

Figure 3:
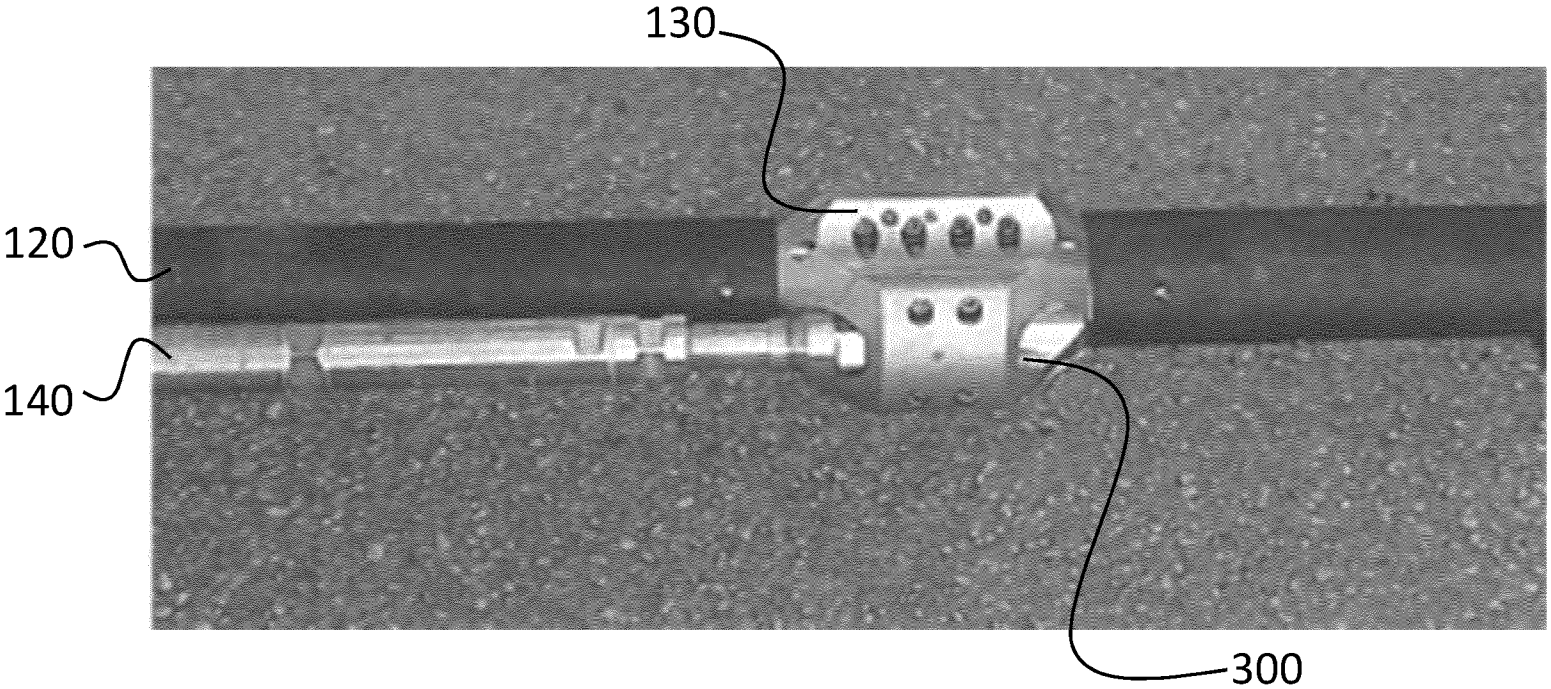
FIG. 3 is a perspective view of tubing with a clamped gauge.

Turning now to FIG. 3, a perspective view of tubing 120 with a gauge 300 clamped to the tubing 120 is shown. The gauge 300 is secured to the tubing by a clamp 130. As shown in FIG. 3, the clamp 130 surrounds the gauge 300 and an outer circumference of the tubing 120. The clamp 130 is secured to the tubing 120 by bolts or screws. As a person skilled in the art will appreciate, the clamp 130 may be secured to the tubing 120 in a variety of ways.

The gauge 300 is configured to detect one or more parameters. As the gauge 300 is external to the tubing 120, the parameter is detected in the environment external to the tubing 120. The gauge 300 may comprise multiple sensing elements configured to detect a variety of parameters. Exemplary parameters include pressure, temperature, pH, force, strain, stress, tension, resistivity and conductivity.

A connector 140 is connected to the gauge 300 and extends from the clamp 130. The connector 140 is adjacent to the tubing 120. The connector 140 provides power to the gauge and/or data communication to and from the gauge 300. The connector 140 is the interface between the gauge 300 and a power source and/or module. One or more transmission mediums, such as wires or cables are located within the connector 140. One end of the wires or cables is connected to the gauge 300. The other end of the wires or cables is connected to the power source and/or a module. The module may be a communication module such as a transceiver configured to transmit detected parameters from the gauge 300 to another location. The power source may be a battery. The other location may be a surface or subsurface location, or another communication module that may be associated with another gauge 300.

While a single gauge 300 clamped to the tubing 120 has been described, a person skilled in the art will appreciate that multiple gauges 300 may be used.

Figure 4:
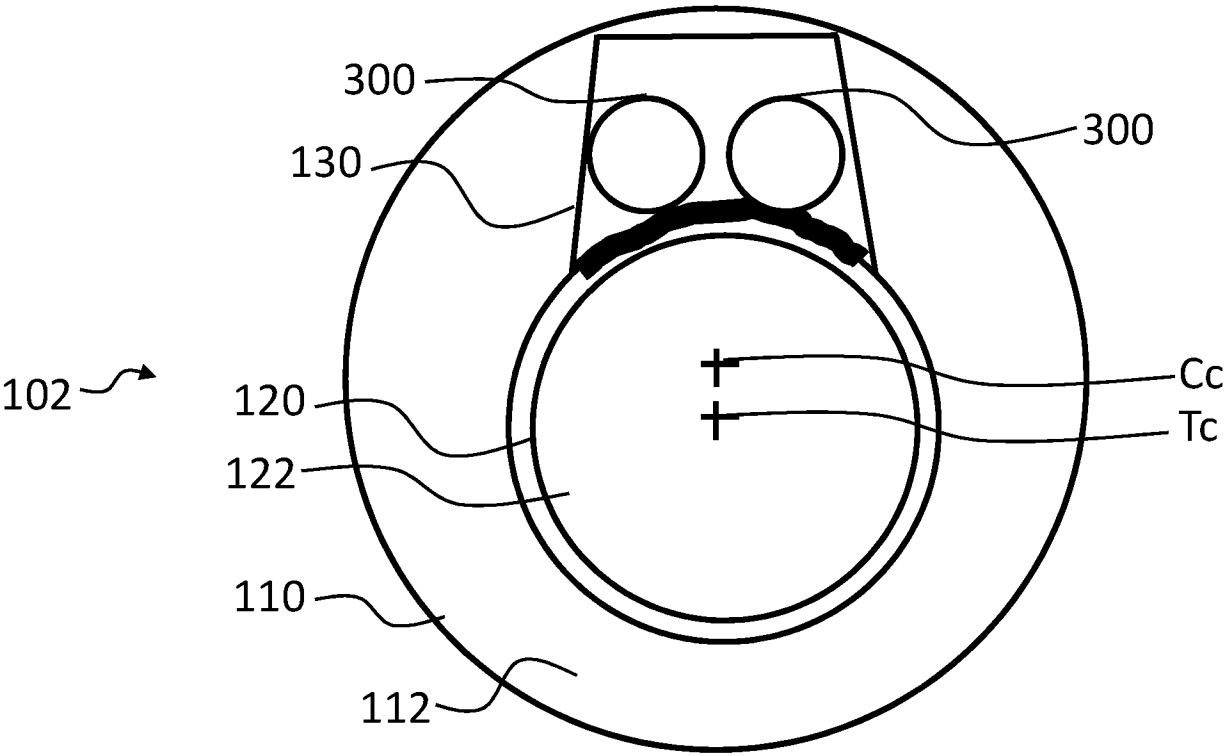
FIG. 4 is an axial cross-sectional view of a well structure.

Turning now to FIG. 4, an axial cross-sectional view of a portion of a well structure 102 is shown.

As previously described, the well structure 102 is generally cylindrical. The well structure 102 comprises the casing 110 forming the exterior of the well structure 102 and the tubing 120 in the interior of the well structure 102. Two gauges 300 are secured to the tubing by a clamp 130. The clamp 130 surrounds the gauges 300 and an outer circumference of the tubing 120.

As clearly shown in FIGS. 3 and 4, the clamp 130 is secured around the tubing 120. The gauges 300 are positioned on one radial side of the tubing 120. The gauges 300 are not positioned radially centrally relative to the tubing 120. That is to say, the gauges 300 are not radially coaxial with the tubing 120. Furthermore, the clamp 130 with the gauges 300 has a greater diameter than the tubing 120. To accommodate for the additional radius of the gauges 300 clamped onto the tubing 120, the tubing 120 is no longer centrally located within the casing 110. The tubing 120 is not positioned radially centrally relative to the casing 110. The tubing 120 is eccentric to casing 110. The tubing 120 has a radial center (Tc) that is different from a radial center (Cc) of the casing 110.

In typical arrangements, the casing 110 has an outer diameter of approximately 9.625 inches (24.448 cm). The casing 110 has an inner diameter of approximately 8.500 inches (21.590 cm). The clamp 130 has an outer diameter (excluding the gauges 300) of approximately 6.156 inches (15.636 cm). Each gauge 300 has an outer diameter of approximately 1.690 inches (4.293 cm). The tubing 120 has an outer diameter of approximately 5.500 inches (13.970 cm). The radial center (Tc) of the tubing 110 is offset from the radial center (Cc) of the casing 110 by 0.710 inches (1.803 cm). As a person skilled in the art will appreciate, these dimensions are exemplary and may be varied depending on the specific application.

During operation, the gauges 300 are clamped to the tubing 120 and the tubing is run or deployed into the casing. As previously discussed, as the gauges 300 are external to the tubing 120, the gauges are exposed during deployment or running of the tubing 120. As such, the gauges 300 are vulnerable to damage during deployment or running of the tubing 120. In particular, the gauges 300 may be damaged through contact with the wellbore, outer casing, etc. during deployment or recovery.

Furthermore, as the gauge 300 is present in the annulus 112 of the casing 110, the diameter of the tubing 120 must be reduced to accommodate for the additional diameter of the gauge 300 within the annulus 112. This results in tubing 120 of sub-optimal diameter which reduces downhole fluids that be drawn from the tubing 120 and generally reduces efficiency of the well 100.

In addition, as previously described, the tubing 120 is eccentric with the casing 110 due to presence of the gauge 300 clamped to the outside of the tubing 120. This increases side force on the tubing, and may increase frictional force or frictional loading during deployment of the tubing 120 compared to non-eccentric tubing. In addition, the risk of the tubing 120 becoming stuck in casing 110 is increased. Moreover, flexible tubing joints may be required between tubing 120 sections, and other sections of tubing 120 that require concentric connections, such as packers and plugs.

Figure 5:
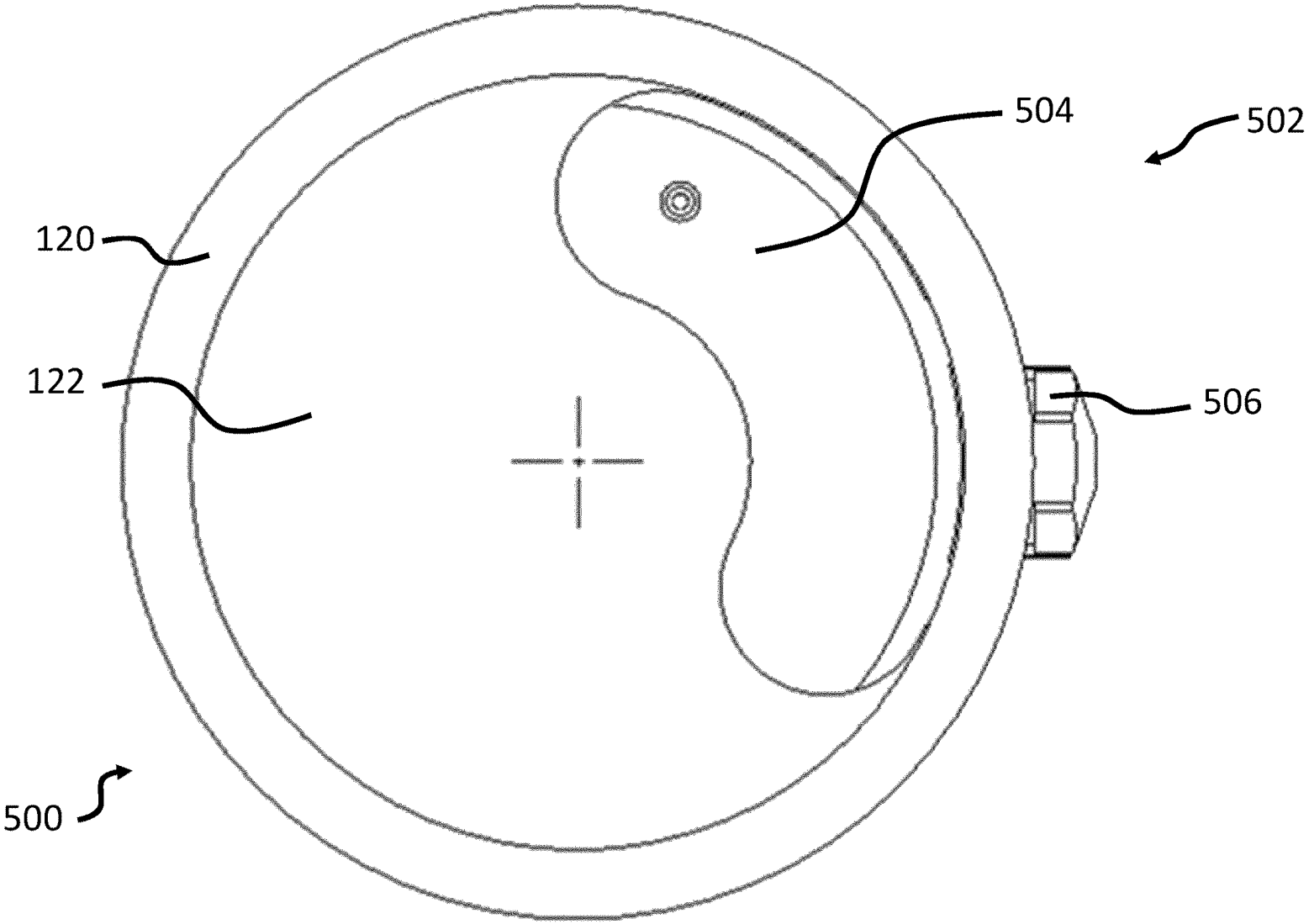
FIG. 5 is an axial view of a tubing assembly.

Turning now to FIG. 5, a tubing assembly 500 is shown. The tubing assembly 500 is configured for use in a wellbore, i.e. the wellbore of well 100. The tubing assembly 500 comprises tubing 120. As previously described, the tubing 120 may be configured to be run in a wellbore to recover downhole fluid from one or more formations, although other types of tubing may alternatively be used.

In this embodiment, the tubing 120 is production tubing. The tubing 120 forms part of the production string through which production fluid from the formation runs. The tubing 120 runs for some portion or the entire longitudinal length of the wellbore of the well 100. The tubing 120 is generally cylindrical. The tubing 120 is hollow. The tubing 120 defines an interior generally cylindrical volume known as the bore 122. The tubing 120 may be made of steel, steel alloys or other generally corrosive resistant materials in which production fluid may flow.

The tubing assembly 500 further comprises at least one gauge 502. The gauge 502 is positioned at least partially inside the tubing 120. In some arrangements, the gauge 502 may be positioned entirely within the tubing 120. The gauge 502 is configured to detect a parameter inside the tubing 120. As will be described, the gauge 502, in this embodiment, comprises multiple sensing elements configured to detect parameters. Exemplary parameters include pressure, temperature, pH, force, strain, stress, tension, resistivity and conductivity.

As shown in FIG. 5, the gauge 502 is ported through the tubing 120. Specifically, the gauge 502 is ported through a sidewall of the tubing 120. In such exemplary arrangements, the gauge 502 is configured to detect a parameter inside the tubing 120 and outside of the tubing 120.

In this embodiment, the gauge 502 is configured to detect a parameter in the annulus 112 defined between casing 110 and the tubing 120, and a parameter in the bore 122 of the tubing 120 as will be described. As a person skilled in the art will appreciate, the gauge 502 may be configured to detect the same or different parameters in the annulus 112 and the bore 122. Furthermore, the gauge 502 may be configured to detect only a parameter in the bore 122 of the tubing 120, only a parameter in the annulus 112 of the casing, or a parameter in the bore 122 and the annulus 112.

The gauge 502 comprises a gauge body 504 secured to the tubing 120. The gauge body 504 is secured to the tubing by a bolt 506, although as a person skilled in the art will appreciate, other fastening or securing means may be used. The gauge body 504 is positioned within the bore 122 of the tubing 120. A portion of the gauge 502 is within the tubing 120, i.e. in the bore 122. In this embodiment, the portion of the gauge 502 within the tubing 120 is shaped to fit the interior surface of the tubing 120. In this embodiment, the portion of the gauge 502 that is within the tubing 120 is the gauge body 504. The gauge body 504 has a generally arcuate shape that matches the circular sidewall of the tubing 120. The gauge body 504 spans a portion of the circular curve of the interior of the tubing 120. The portion is approximately one quarter of the inner circumference of the tubing 120. The gauge body 504 is generally jellybean shaped.

Figure 6:
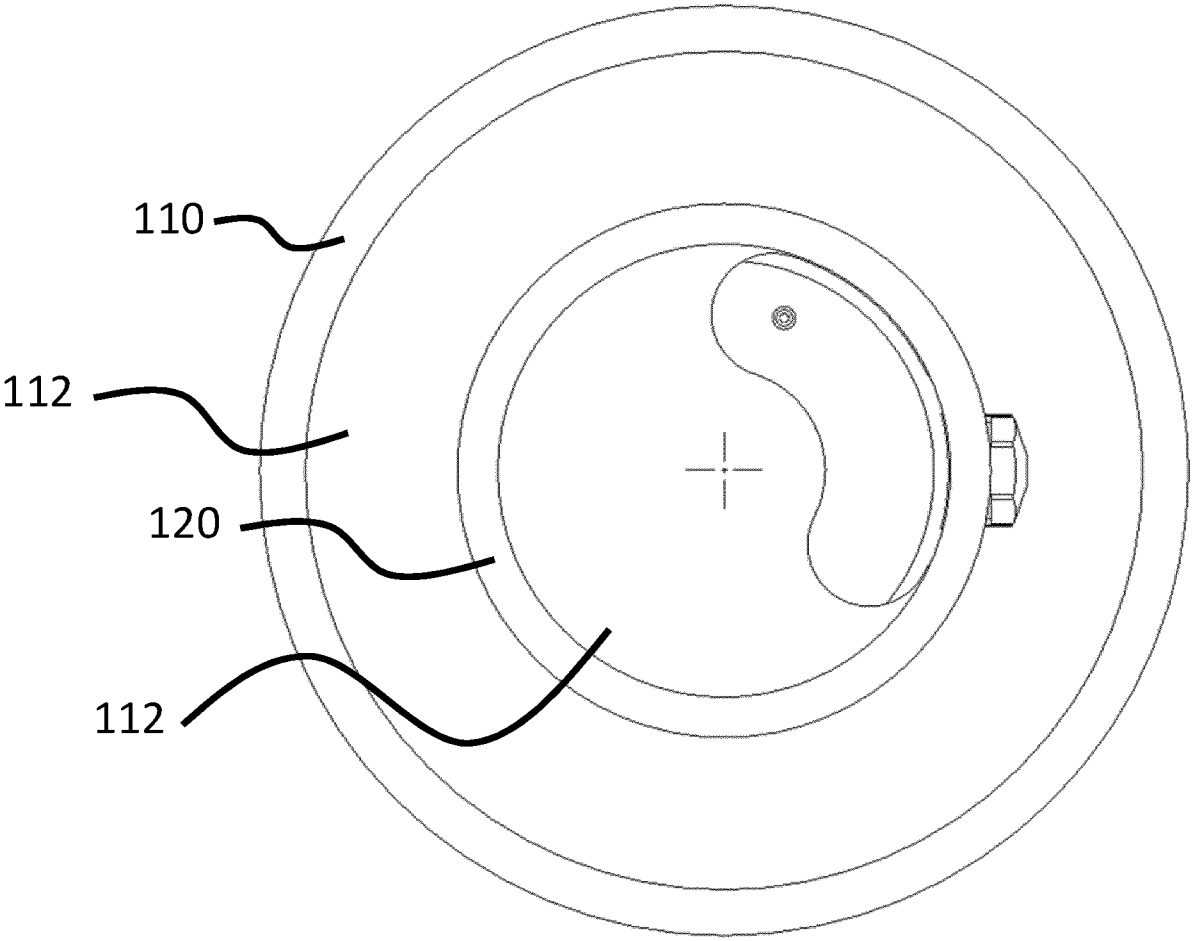
FIG. 6 is an axial view of a tubing assembly within casing.

As shown in FIG. 6, the tubing 120 is surrounded by casing 110. The casing 110 serves to prevent the formation exterior to the casing 110 from caving into the wellbore of the well 100. The casing 110 may further or alternatively, isolate different formations to prevent the flow or cross flow of formation fluid. The casing 110 may further or alternatively, provide a means of maintaining control of formation fluids and pressure as the well 110 is drilled.

The casing 110 is generally cylindrical. In this embodiment, the casing 110 is steel pipe. The casing 110 is hollow. The casing 110 comprises interconnected casing segments, which form the entire casing run. The casing 110 runs for some portion or the entire longitudinal length of the wellbore of the well 100. In use, the casing generally cemented into place within the well 100 once the wellbore is drilled.

The casing 110 defines an interior generally cylindrical volume known as an annulus 112. The tubing 120 is positioned within the annulus 112. The tubing 120 is within the interior defined by the casing 110. In this embodiment, the tubing 120 is centrally located within the annulus 112. In this embodiment, the tubing 120 is radially centrally positioned using one or more packers (not shown). The packers may be mechanical set packets, tension-set packers, rotation-set packers, hydraulic-set packers, inflatable packers, permanent packers and/or cement packers.

Figure 7:
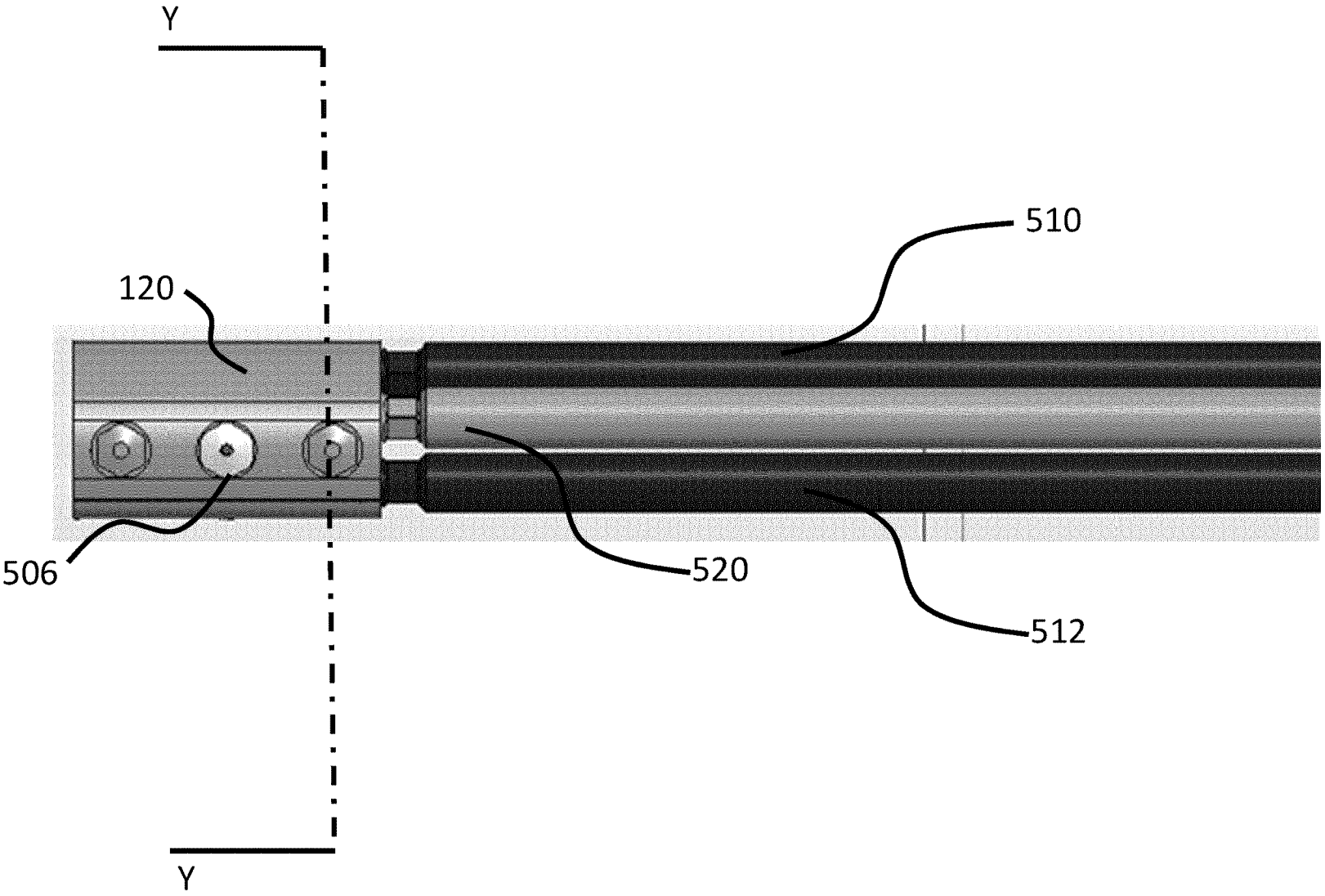
FIG. 7 is a longitudinal view of a tubing assembly with a portion of tubing removed.

Turning now to FIG. 7, a longitudinal view of the gauge 502 with a portion of the tubing 120 removed, for clarity, is shown. As shown in FIG. 7, the gauge 502 further comprises a first sensing element 510 and a second sensing element 512. The first sensing element 510 is configured to detect one or more parameters within the bore 122 of the tubing 120 and a second sensing element 512 configured to detect one or more parameters within the annulus 112 between the tubing 120 and the casing 110. The sensing elements 510 and 512 are located within the bore 122 of the tubing 120. The sensing elements 510 and 512 are cylindrical members that are axially parallel with the longitudinal with the tubing 120. A person skilled in the art will appreciate other configurations are possible. The sensing elements 510 and 512 interact with the gauge body 504 as will be described.

Figure 8:
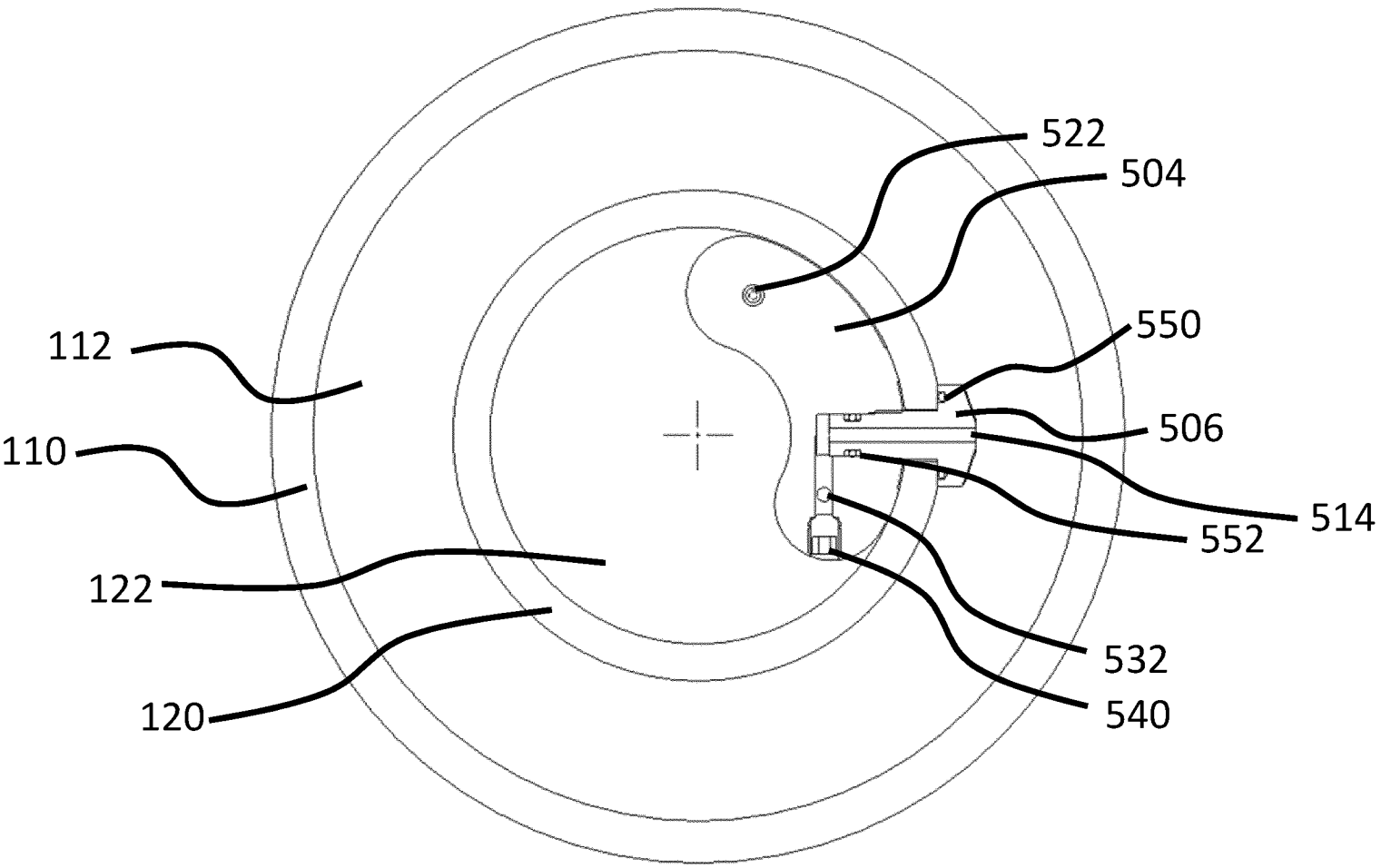
FIG. 8 is an axial cross-sectional view of the tubing assembly within casing along the section lines Y-Y of FIG. 7.

As shown in FIG. 8, the first sensing element 510 is configured to detect one or more parameters within the bore 122 via a bore port 522 in the gauge body 504. The second sensing element 512 is configured to detect one or more parameters within the annulus 112 via an annulus port 532 positioned within a passageway 514 of the bolt 506. The bolt 506 is blanked such that the passageway 514 provides fluid communication from the annulus 112, defined between the tubing 120 and an outer liner or casing 110, and the bore 122 of the tubing 120.

The bolt 506 is shaped such that the head of the bolt 506 is outside the tubing 120. The bolt 506 may be flush with the tubing 120 outer wall such that the tubing assembly 500 is generally cylindrical. The bolt 506 may be threaded to be secured to the gauge body 504. The bolt 506 may comprise threaded and unthreaded portions (e.g. a shank).

The bolt 506 may be further secured to tubing 120 by tubing screws 550 in the head of the bolt 506. The tubing screws 550 are axially parallel with the longitudinal axis of the bolt 506. Two tubing screws 550 are positioned on opposite diametric ends of the bolt 506.

The bolt 506 is further secured to the gauge body 504 by gauge screws 552. The gauge screws 552 are axially perpendicular with the longitudinal axis of the bolt 506. Two gauge screws 552 are used. The gauge screws 552 may be secured to the threaded portion or the shank of the bolt 506 so as to not affect the connection of the bolt 506 to the gauge body 506. A person skilled in the art will appreciate that that more or fewer tubing screws 550 and/or bolt screws 552 may be used.

The passageway 514 in the bolt 506 is plugged by a plug 540. The plug 540 is threaded into a threaded portion of the passageway 514 although the plug 540 may secured within the passageway 514 by other means. The plug 540 prevents fluid communication between the passageway 514 and the bore 122 of the tubing 120 to ensure the second sensing element 512 is detecting a parameter within the annulus 112.

Seals or gaskets such as O-rings may be used in relation to each sensing element 510 and 512 to ensure fluid does not flow between the annulus 112 of the casing 110 and the bore 122 of the tubing 120. Furthermore, seals or gaskets such as O-rings may be used in relation to the bolt 506 to ensure fluid does not flow between the annulus 112 and the bore 122.

The bolt 506 extends just beyond the outer surface of the tubing 120. However, the bolt 506 may be in-line with the outer surface of the tubing 120 such that the diameter of the tubing 120 is not increased. Thus, the tubing 120 may be concentric with casing 110 surrounding the tubing 120 and the previously discussed issues relating to eccentricity are at least partially remedied or avoided.

While only a single bolt 506 and gauge body 504 have been shown in FIGS. 5, 6 and 8, the gauge 502 may comprise multiple bolts 506 and associated gauge bodies 504 as shown in FIG. 7. Each bolt 506 and gauge body 504 may be associated with one or more sensing elements 510 and 512 configured to detect the same or different parameters.

Figure 9:
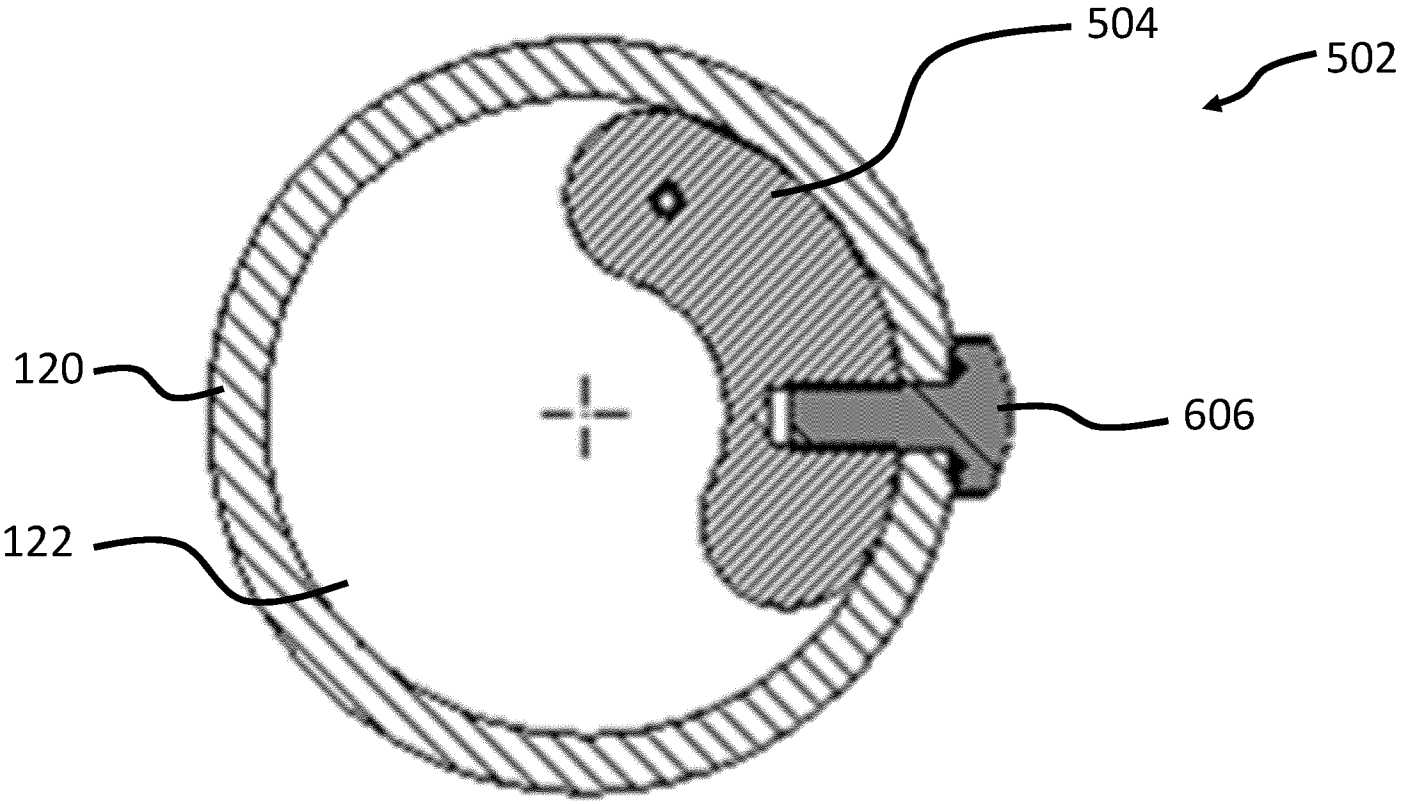
FIG. 9 is an axil view of a tubing assembly.

While a particular bolt 506 has been described, a person skilled in the art will appreciate that other configurations are possible. Turning now to FIG. 9, another bolt 606 is shown. The bolt 606 is the same as previously described bolt 506 with the exception that the bolt 606 does not comprise the passageway 514. The gauge 502 shown in FIG. 9 is therefore only configured to only detect a parameter in the bore 122 of the tubing 120.

The sensing elements 510 and 512 are configured to communicate detected parameters to a communication module 520 via wired connections, although a person skilled in the art will appreciate that other configurations are possible. As shown in FIG. 7, the communication module 520 is located within the bore 122 of the tubing 120. The communication module 520 is a generally cylindrical member that is axially parallel with the longitudinal axis of the tubing 120. The communication module 520 is axially parallel with the sensing elements 510 and 512.

Wired communication comprises communication through a guided transmission medium, such as a wire, other metallic structure or a material having high electromagnetic (EM) conductivity relative to a surrounding medium. In another embodiment, the sensing elements 510 and 512 are configured to communicate detected parameters to the communication module 520 via wireless communication. Wireless communication methods are not through a guided transmission medium. Wireless communication methods are through air, water, ground (or formation) or another medium such as tubing or casing. Wireless communication methods may utilize electromagnetic technology, acoustic technology and/ or pressure wave technology, or combinations thereof. The communication module 520 may comprise a wireless or wired modem.

The communication module 520 is configured to receive the parameters detected by the sensing elements 510 and 512 and store or record the parameters. The communication module 520 may be further configured to transmit the received parameters as will be described. In this embodiment, the communication module 520 comprises a processor, computer medium and/or storage medium. In this embodiment, the communication module 520 is further configured to determine the difference between detected parameters from the sensing elements 510 and 512 to determine a delta of the detected parameter.

In this embodiment, the first sensing element 510 is configured to detect a pressure in the bore 122 and the second sensing element 512 is configured to detect a pressure in the annulus 112 of casing 110 surrounding the tubing 120. The communication module 520 receives both detected pressures and determines a difference between the pressure to determine the pressure differential or delta across the tubing 120.

The communication module 520 may be configured to receive a signal and/or transmit a signal. The signal is communicated via the previously described wired or wireless communication. The signal is at least one of a power signal and a data signal.

In this arrangement, the communication module 520 is configured transmit and/or receive the signal from another tubing assembly 500, i.e. a communication module 520 of another tubing assembly 500 associated with another gauge 502. Alternatively or in addition, the communication module 520 is configured to transmit and/or receive the signal from a surface location. Such surface location may provide power downhole to the tubing assembly 500 or transmit/receive signals to/from the communication module 520. The surface location may receive parameters detected by the sensing elements 510 and 512 via the communication module 520.

In exemplary arrangements shown above, the gauge body 504 is positioned against an internal wall of the tubing 120. As such, the gauge body 504 is offset from a longitudinal central axis of the tubing 120. In other arrangements, the gauge body 504 may be differently positioned. In particular, the gauge body 504 may be held away from the internal wall of the tubing 120. In a specific arrangement, the gauge body 504 may be positioned such the gauge body 504 is coincident with the longitudinal central axis of the tubing 120. The center of mass of the gauge body 504 may be coincident with the longitudinal central axis of the tubing 120.

While the sensing elements 510 and 512, and communication module 520 are shown as being radially distributed in the bore 122 of the tubing 120, the sensing elements 510 and 512, and communication module 520 may be offset from a longitudinal central axis of the tubing 120. The sensing elements 510 and 512, and communication module 520 positioned against an internal wall of the tubing 120.

Figure 10:
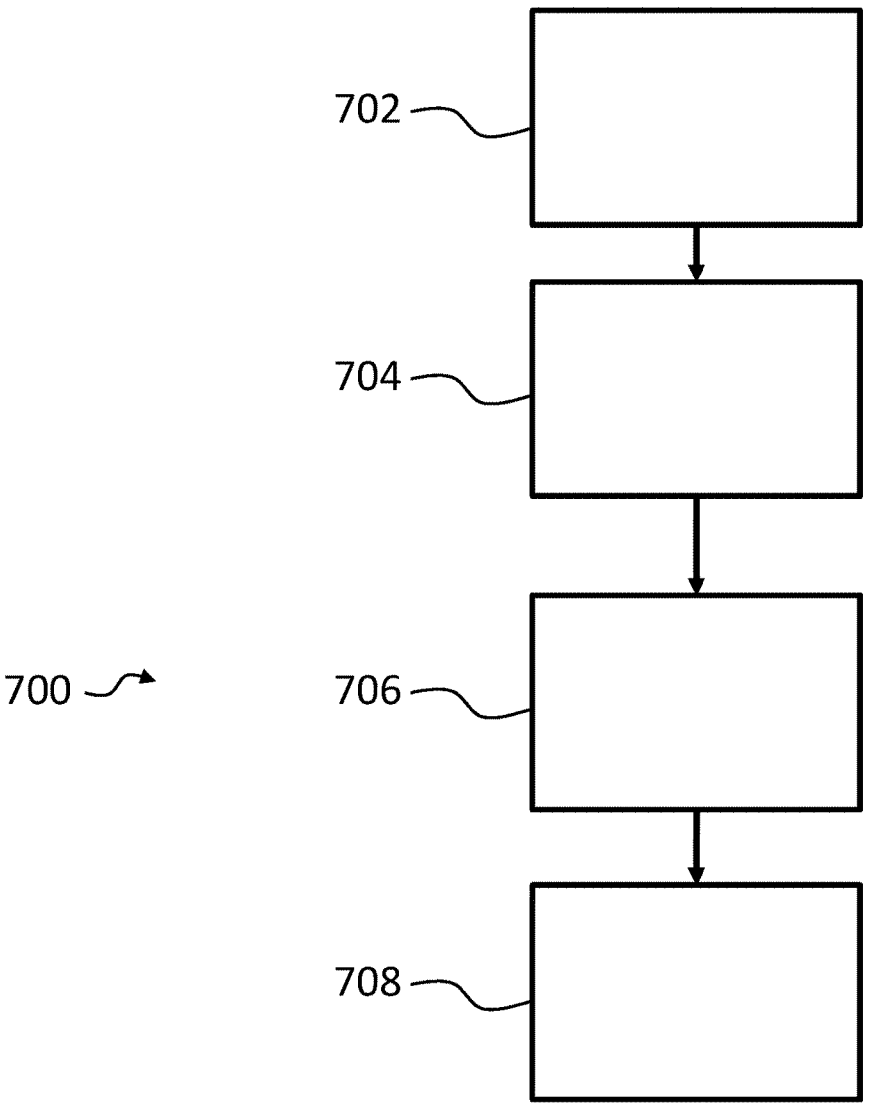
FIG. 10 is a flowchart of a method of running tubing in a wellbore.

Turning now to FIG. 10, a flowchart of a method 700 of running tubing in a wellbore is shown. The method 700 comprises positioning 702 at least one gauge 502 partially inside tubing 120 to form the tubing assembly 500. The tubing 120 is configured for use in recovering downhole fluid from one or more formations. The gauge 502 is configured to detect a parameter inside the tubing 120, i.e. in the bore 122 of the tubing 120. The method 700 further comprises installing 704 the tubing assembly 500 in the wellbore of a well 100.

In this embodiment, positioning 702 the gauge 502 comprises porting the gauge 502 through tubing 120 such that the gauge 502 is configured to detect a parameter inside the tubing 120, i.e. the bore 122 of the tubing 120, and a parameter outside the tubing, i.e. in the annulus 112 of casing 110 surrounding the tubing 120.

In this embodiment, porting the gauge 502 comprises positioning the first sensing element 510 of the gauge 502 inside the bore 122 of the tubing 120. Porting further comprises positioning the second sensing element 512 of the gauge 502 inside the tubing 120.

As previously described, the gauge 502 comprises the gauge body 504 secured to the tubing 120 by the bolt 506. Porting the gauge 502 comprises securing the gauge body 504 to the tubing 120 with the bolt 506. Specifically, porting the gauge 502 comprises forming a hole or the passageway in the bolt 506. Porting further comprises positioning the sensing elements 510 and 512 such that the first sensing element 510 is configured to detect a parameter in the bore 122 via the bore port 522 in the gauge body 504, and the second sensing element 512 is configured to detect a parameter in the annulus 112 via the annulus port 532 in the passageway 514.

Positioning 702 may further comprise securing the bolt 506 to the tubing 120 with fasteners, in particular, tubing screws 550. Positioning 702 may further comprise securing the bolt 506 to the gauge body 504 with fasteners, in particular gauge screws 552.

In this embodiment, the method 700 further comprises detecting 706 the parameter inside and outside the tubing 120. Detecting 706 comprises detecting a parameter via the first sensing element 510 and detecting a parameter via the second sensing element 512. The detected parameters are then communicated to the communication module 520 of the gauge 502. The communication module 520 compares the detected parameters to determine a difference between the parameters. In this embodiment, the communication module 520 determines a pressure difference between the bore 112 and the annulus 122 to determine a pressure differential in the tubing 120.

In this embodiment, the method 700 further comprises communicating 708 a signal from the gauge 502. The signal is communicated via wired and/or wireless communication as previously described. The signal is one of a power and a data signal. The power signal provides power to another piece of equipment such as another gauge 502. The data signal is a control signal or data parameters detected by the gauge 502. In exemplary arrangements, the control signal is communicated from the gauge 502 to another gauge 502 to control retrieval, acquisition or transmission of parameters. The signal may be communicated via the communication module 520.

In exemplary arrangements, the signal from the gauge 502 is communicated to another tubing assembly 500 comprising another gauge 502 or a remotely located controller or storage. The remotely located controller or storage may be located at the surface. The controller or storage comprises memory, one or more processors or processing devices, central processing unit (CPU), cache, read-only memory (ROM) and/or random-access memory (RAM).

In this embodiment, prior to installing the tubing assembly 500, the wellbore of the well 100 is lined with casing 110.

In this embodiment, the tubing 120 is production tubing. Furthermore, in this embodiment, the parameter detected is at least one of pressure, temperature, pH, force, strain, stress, tension, resistivity and conductivity.

Thus, in use, wellbore of the well 100 is drilled. The wellbore is then lined with casing 110 that is cemented into place. A hole is then made in the sidewall of tubing 120. The gauge body 504 is positioned within the bore 122 of the tubing 120 and secured to the tubing 120 via the bolt 506 positioned in the hole. The first sensing element 510 is positioned within the tubing 120 and configured to detect a parameter in the bore 122 of the tubing 120, and the second sensing element 512 is positioned within the tubing 120 and configured to detect a parameter in the annulus of the casing 110. The communication module 120 is positioned within the tubing 120 and communicatively connected to the sensing elements 510 and 512. Multiple gauge bodies 504, bolts 506, sensing elements 510 and 512, and/or communication modules 520 may be positioned in the tubing 120. The tubing assembly 500 is then installed, deployed or run in the wellbore. Multiple tubing assemblies 500 may be installed in the wellbore. The sensing elements 510 and 512 are configured to detect the parameter. The sensing elements 510 and 512 are further configured to communicate the detected parameters to the communication module 520 of the gauge 502. The communication module 520 is configured to store the detected parameters and compares the parameters to determine a differential of the parameters. The communication module 520 is configured to communicate the differential to a surface location via wireless communication.

Figure 11:
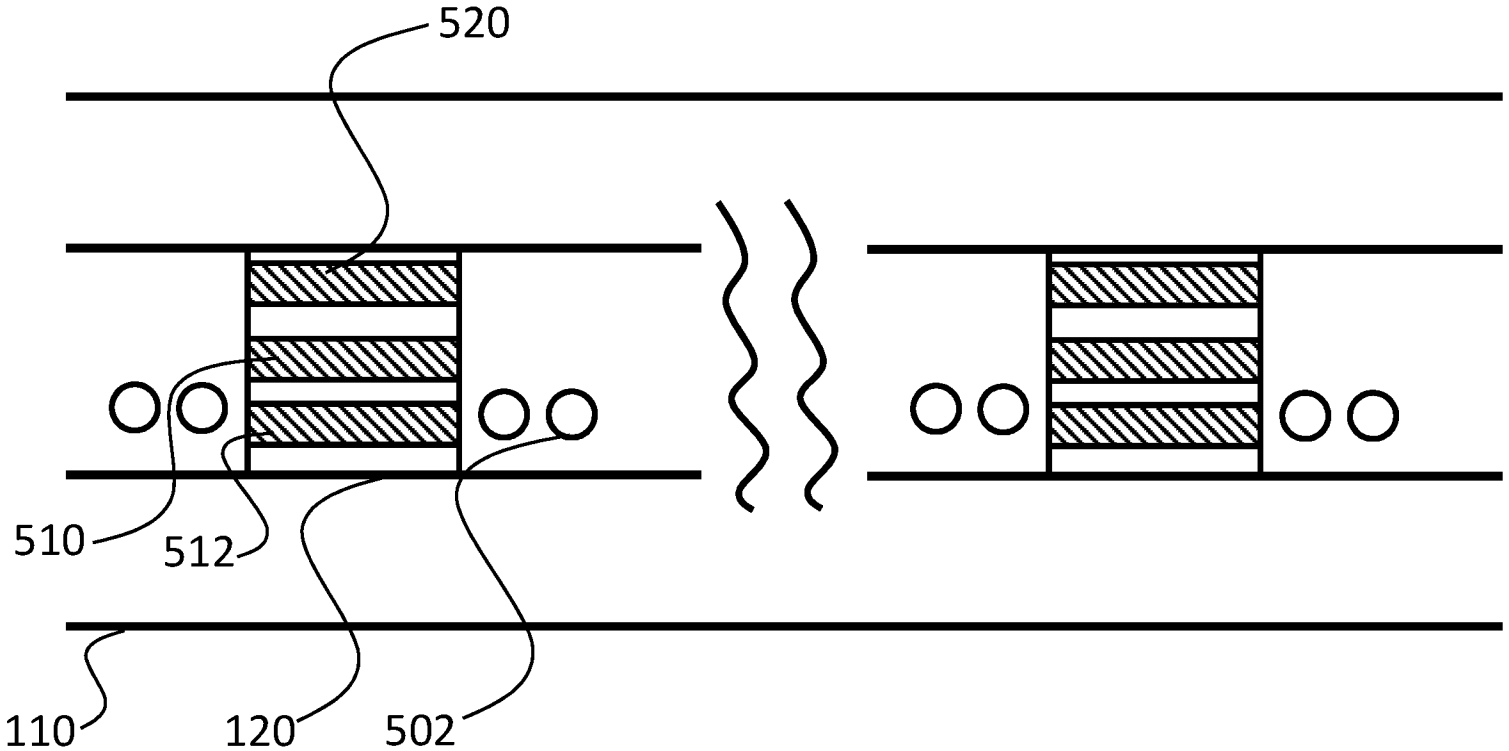
FIG. 11 is a longitudinal view of multiple tubing assemblies arranged in casing.
Figure 12:
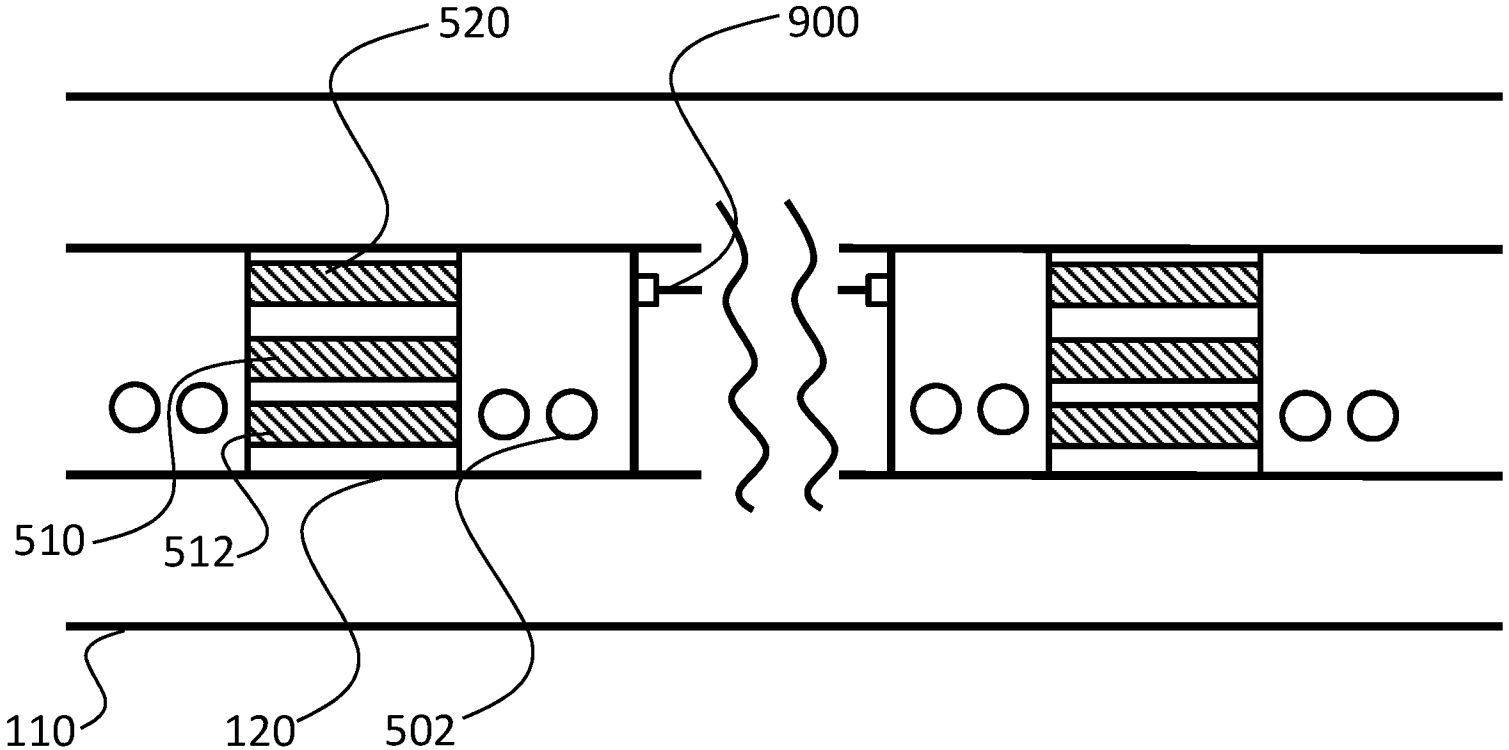
FIG. 12 is a longitudinal view of another embodiment of multiple tubing assemblies arranged in casing.

As previously described, multiple tubing assemblies 500 may be used. Furthermore, each tubing assembly 500 may comprise multiple gauges 502. Turning now to FIGS. 11 and 12, multiple tubing assemblies 500 arranged in casing 110 are shown.

In FIG. 11, the gauges 502 of the tubing assemblies 500 are configured to communicate via wireless communication. In FIG. 12, the gauges 502 are configured to communicate via wireless and wired communication as will be described. Break lines indicate that the elements shown in the figures are of indefinite length.

In FIG. 11, the tubing assemblies 500 are shown with a portion of the tubing 120 cut away for clarity. Each tubing assembly 500 comprises multiple tubing gauges 502 and at least one module 520. Furthermore, multiple tubing assemblies 500 are present.

In this embodiment, the tubing assembly 500 nearest the top most portion of the wellbore, e.g. the surface or mudline 104, receives the parameters detected by the other gauges 502 of the other tubing assemblies 502. Specifically, each communication module 520 (except for the top most communication module) communicates the detected parameters to the top most communication module 520 of the top most tubing assembly 500. The communication module 520 of each of the lower tubing assemblies 500 records or stores the detected parameters and the communication modules of each of the lower tubing assemblies 500 communicates the recorded parameters via wireless communication. As will be appreciated, the communication modules 520 may not record the detected parameters and instead the communications modules may simply communicate the detected parameters directly. The top most communication module 520 receives the parameters and records or stores the parameters. In this embodiment, the top most communication module 520 communicates the parameters to a remote location, e.g. a surface located module.

While a particular configuration of multiple tubing assemblies 500 has been described, a person skilled in the art will appreciate that other configurations are possible. Turning now to FIG. 12, multiple tubing assemblies 500 arranged in casing 110 are shown. As previously stated, multiple tubing gauges 502 are present in a single tubing assembly 500. Furthermore, multiple tubing assemblies 500 are present. Unless otherwise stated, the multiple tubing assemblies 500 shown in FIG. 11 are arranged in the same manner as those in FIG. 11.

In this embodiment, while the top most tubing assembly 500 comprises a communication module 520 configured to communicate via wireless communication, the lower communication modules are configured to communicate via wired communication. As shown in FIG. 12, the lower communication modules are electrically connected via wires or cables 900.

Thus, in use, the lower gauges 502 detect parameters. The parameters are recorded or stored at the associated communication modules 520. The stored parameters are then communicated via the cables to the communication module 520 associated with the topmost tubing assembly 500. The received parameters are then recoded or stored in the topmost communication module 520. The topmost communication module then communicates the parameters via wireless communication to a remote location, e.g. a surface located module.

A person skilled in the art will appreciate that the parameters may be communicated directly without being recorded or stored.

As will be appreciated, the described tubing assembly 500 may be used in a variety of applications. In particular, the tubing assembly 500 may be used in a methane hydrate well or other types of wells in which sand screens are used. In these applications, a sand screen surrounds the tubing 120. The sand screen is wrapped around the tubing 120. The sand screen is generally cylindrical once it is wrapped around the tubing 120.

The sand screen is configured to separate particles from fluid to ensure that the particles to enter into the bore 122 of the tubing 120. As the gauge 502 is configured to detect a parameter outside of the tubing 120, i.e. in the annulus 112 of the casing 110, the gauge 502 is ported through the sand screen. However, as the gauge 502 is mounted in the tubing 120, a large area of the sand screen does not have to be sacrificed to detect the parameter outside the tubing 120 compared to prior art systems.

As the gauge 502 is ported through the tubing 120, the gauge 502 can detect parameters on either side of the sand screen, i.e. in the bore 122 and in the annulus 112, without sacrificing a large area of the sand screen and reducing efficiency. In comparison with prior art arrangements, large portions of the sand screen need not be sacrificed which reduces the ability of the sand screen to separate particles from fluid and decreases efficiency resulting in sub-optimal fluid flow.

The applicant discloses in isolation each individual feature described herein and any combination of two or more such features, to the extent that such features or combinations are capable of being carried out based on the specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description, it will be evident to a person skilled in the art that various modifications may be made within the scope of the invention.

The invention claimed is:

1. A tubing assembly for use in a wellbore, the wellbore having a length that extends longitudinally, the tubing assembly comprising:

a tubing that is cylindrically configured with a bore and an outer surface disposed at outer diameter, wherein the tubing and the bore extend along a longitudinal length and the outer diameter is constant along the longitudinal length of the tubing; and a gauge disposed within the bore of the tubing, wherein at least a portion of the gauge is secured to the tubing by a fastener, wherein the gauge is ported through the tubing by at least one port such that the gauge is configured to detect a first parameter inside the tubing and a second parameter outside the tubing, wherein the at least one port is positioned within a body of the gauge and within a passageway within the fastener, wherein the first parameter is at least one of pressure, temperature, pH, force, strain, stress, tension, resistivity, or conductivity, and wherein the second parameter is at least one of pressure, temperature, pH, force, strain, stress, tension, resistivity, or conductivity.

2. The tubing assembly of claim 1, wherein the gauge is ported through a sidewall of the tubing.

3. The tubing assembly of claim 1, wherein the gauge comprises a first sensing element that is configured to detect the first parameter inside the bore.

4. The tubing assembly of claim 3, wherein the gauge comprises a second sensing element configured to detect the second parameter outside the tubing, wherein the second parameter is at least one of pressure, temperature, pH, force, strain, stress, tension, resistivity, or conductivity.

5. The tubing assembly of claim 3, wherein the first sensing element is configured to detect the first parameter through the at least one port.

6. The tubing assembly of claim 1, further comprising a communication module configured to transmit and/or receive a data signal representative of the first parameter.

7. The tubing assembly of claim 1, wherein the wellbore is lined with a casing; and wherein the tubing assembly is configured to be positioned within the casing.

8. A tubing assembly for use in a wellbore, the wellbore having a length that extends longitudinally, the tubing assembly comprising:

a tubing that is cylindrically configured with a bore and an outer surface disposed at outer diameter, wherein the tubing and the bore extend along a longitudinal length and the outer diameter is constant along the longitudinal length of the tubing;

a gauge disposed within the bore of the tubing, the gauge comprising a body, a first port disposed in the body, and a first sensing element, the first sensing element configured to detect a first parameter inside the bore of the tubing through the first port, wherein the first parameter is at least one of pressure, temperature, pH, force, strain, stress, tension, resistivity, or conductivity; and a fastener securing the body of the gauge to the tubing, the fastener including a passageway configured to permit sensing of a fluid disposed outside of the tubing.

9. A method of installing a tubing in a wellbore, the wellbore having a length that extends longitudinally, the method comprising:

a tubing that is cylindrically configured with a bore and an outer surface disposed at outer diameter, wherein the tubing and the bore extend along a longitudinal length and the outer diameter of the tubing is constant along the longitudinal length of the tubing; and disposing a gauge within the bore of the tubing to form a tubing assembly, the tubing configured for use in recovering a downhole fluid, the gauge comprising a body, a first port disposed in the body, and a first sensing element, the first sensing element configured to detect a first parameter inside the bore of the tubing through the first port, wherein the first parameter is at least one of pressure, temperature, pH, force, strain, stress, tension, resistivity, or conductivity;

securing the body of the gauge to the tubing by a fastener, the fastener including a passageway configured to permit sensing of a fluid disposed outside of the tubing; and installing the tubing assembly in the wellbore.

10. The method of claim 9, wherein the step of disposing the gauge comprises porting the gauge through the tubing such that the gauge is configured to detect the first parameter inside the bore of the tubing and detect a second parameter outside the tubing, wherein the second parameter is at least one of pressure, temperature, pH, force, strain, stress, tension, resistivity, or conductivity.

11. The method of claim 10, wherein the porting the gauge comprises positioning the first sensing element of the gauge inside the bore of the tubing.

12. The method of claim 11, wherein the porting the gauge comprises positioning a second sensing element of the gauge inside the bore of the tubing.

13. The method of claim 12, further comprising detecting the first parameter (FP) using the first sensing element and producing FP data signals representative of the detected first parameter;

detecting the second parameter (SP) using the second sensing element and producing SP data signals representative of the detected second parameter; and comparing the first parameter and the second parameter using the FP data signals and the SP data signals.

14. The method of claim 10, further comprising communicating a signal from the gauge, wherein the signal is at least one of a power signal or a data signal, and the communicating includes communicating the signal from the gauge to a second gauge disposed in the bore of the tubing, or to a remotely located controller.

* * * * *